United States Patent [19]

Cook

[11] 4,084,993

[45] Apr. 18, 1978

[54] STABLE BLASTING SLURRY

[76] Inventor: Melvin A. Cook, 2026 Beneficial Life Tower, The ZCMI Center, 36 S. State St., Salt Lake City, Utah 84111

[21] Appl. No.: 726,300

[22] Filed: Sep. 24, 1976

Related U.S. Application Data

[63] Continuation-in-part of Ser. No. 705,593, Jul. 15, 1976, abandoned.

[51] Int. Cl.[2] ..... C06B 36/10

[52] U.S. Cl. ..... 149/39; 149/41; 149/43; 149/56; 149/57; 149/69; 149/105

[58] Field of Search ..... 149/39, 41, 43, 56, 149/105, 57, 69

[56] References Cited

U.S. PATENT DOCUMENTS

| | | | |
|---|---|---|---|
| 3,406,051 | 10/1968 | Fearnow | 149/105 X |
| 3,834,954 | 9/1974 | Samuelsen | 149/105 X |

*Primary Examiner*—Stephen J. Lechert, Jr.
*Attorney, Agent, or Firm*—Thomas A. Wilson

[57] ABSTRACT

This invention relates to stabile blasting slurry systems useful particularly with the latest blasting slurry trucks, involving the preparation of particular new fuel liquids mixed with particular oxidizer liquids and including in most embodiments solid oxidizers and solid fuels.

44 Claims, No Drawings

STABLE BLASTING SLURRY

This application is a continuation-in-part of U.S. Ser. No. 705,593, filed July 15, 1976, now abandoned.

The present invention relates to safer and more suitable blasting slurries and their manufacture.

For convenience throughout this document, the following terms will be used. The sensitizing fuel ingredient will be called "fuel sensitizer." The fuel sensitizer disposed in a carrier liquid will be called a "fuel liquid." The aqueous oxidizing component of the slurry will be called an "oxidizer liquid." Both the fuel liquid and the oxidizer liquid (each defined hereafter) can be either a solution, a dispersion, or an emulsion.

The slurry systems of the present invention are useful in any movable or stationary bulk mixing system, including slurry "pump trucks." They are particularly useful in conjunction with our new slurry pump truck which is not claimed herein but is described in some detail in connection with the application of the slurry blasting agents described herein. This pump truck is an advance over the prior art in that it contains no augers, no hydraulic or electrical drives, and no ingredient-feed motors. It has been designed to handle two liquids: (1) an "oxidizer liquid" and (2) a "fuel liquid." It is also capable of handling a free-flowing solid oxidizer, e.g., prilled ammonium nitrate, sodium nitrate or calcium nitrate, and a free-flowing fuel, e.g., granular aluminum of appropriate particle size distribution, free-flowing sulfur, flaked naphthalene, paraformaldehyde, urea, coarse sawdust, or any other free-flowing solid fuel. The oxidizer liquid and fuel liquid are fed to a mixing funnel by air pressure. The free-flowing solids are simply permitted to flow by gravity directly through adjustable openings into the mixing funnel. (The solids bins may, if desired, be provided with vibrators to assist the free flow of the solid into the mixing funnel.)

The mixing funnel and final slurry pump and hose (for loading directly into the borehole) of the pump truck may be any one of the several conventional types in use in the industry since 1963 when the "slurry pump truck" was first introduced.

Metering of liquids is done by means of accurate pressure control and by adjustable orifices. The free-flowing solids are metered by means of adjustable openings in the storage bins (and, if desired, by vibrating the bins).

The oxidizer liquid and fuel liquid tanks are designed for maximum safety being tested to withstand pressures of 30 psi, some five or more times higher than the air pressures used to drive the oxidizer and fuel liquids. The latter pressures need not exceed 6 psi in any case, the usual operating pressures being in the range of 4 to 5 psi.

To our knowledge this is the first on-site (slurry mix and) pump truck to employ the air-pressure liquid drive and gravity-flow feed system, slurry pump trucks of prior art, except for minor exceptions, having employed augers for feeding solid oxidizers and solid fuels, and pumps driven either hydraulically or electrically to feed oxidizer liquids and liquid fuels. Obviously the new pump truck is inherently less costly to build and operate and also inherently safer, by virtue of no moving parts in the ingredient feed than those of the prior art. For instance, it can handle safely spherical trinitrololuene (known in the USA as "Pelletol") and granular aluminum products. Greater economy, greater ease of handling slurry ingredients, lower upkeep costs, and greater safety are the essential features of the new pump truck.

On the other hand, the pump truck can, if desired, be built to handle solid oxidizers and solid fuels which are not ordinarily free flowing by introducing fluidized solids techniques. For example, if desired, one may fluidize ordinarily non-free-flowing solids by means of a controlled countercurrent of air introduced at the bottom of the solids bins so that ordinarily non-free-flowing solids will then gravity flow quite as readily as prilled solid oxidizers.

For optimum efficiency and simplicity, the new slurry system is based on two principal liquids: an oxidizer liquid and a fuel liquid. [An "oxidizer liquid" is defined for purposes of describing the present invention as a liquid having an oxygen balance (OB) of 6% or greater and which will not propagate the detonation wave more than three charge diameters with a 2 inches diameter × 2 inches long (about 160 grams) cast 50/50 pentolite booster (hereafter "2 × 2 inches pentolite") in a cardboard tube of $4\frac{7}{8}$ inches inside diameter and about $\frac{1}{8}$ inch wall thickness (hereafter caled "5"). OB is defined as the weight percent oxygen needed (positive for excess and negative for oxygen deficiency) for complete combustion to $CO_2$ and water. For example, ammonium nitrate (hereafter ammonium nitrate) has a (positive) OB of 20; dinitrotoluene (hereafter DNT) has a (negative) OB of −114.3. A "fuel liquid," on the other hand, is defined for present purposes as a liquid having an OB of −6 or less (more negative) and which will not propagate the detonation wave more than three charge diameters in a 5 inch cardboard tube with 2 × 2 inch pentolite as the booster.] An aqueous oxidizer liquid need not contain only an oxidizer and water. As long as (1) the OB of the liquid exceeds +6 and (2) the liquid is not explosive per se (in the above definition of being explosive), it may be classed for present purposes as an oxidizer liquid even though it may contain fuel ingredients. For instance, a solution comprising 73.7% ammonium nitrate, 8% urea, 0.3% gum, and 18% water has an OB of +8 and is not explosive per se as a liquid below 80° C. It is thus herein classed as an oxidizer liquid.

Likewise the fuel liquid may contain some oxidizer. Yet as long as it has an oxygen balance of −6 or more negative than −6 and the solution is still not an explosive per se (by the above definition), it is here classed as a "fuel liquid."

While we prefer to use only one oxidizer liquid tank, one fuel liquid tank, one bin for free-flowing solid oxidizer, and one bin for free-flowing fuel on any particular truck, it may prove desirable in some cases to utilize more than one of each of these types of slurry-ingredient containers.

Likewise, the relative size of the liquid tanks and the bins need not be limited; yet for optimum efficiency, the sizes of each of the tanks and bins should be carefully selected for any particular slurry system one wishes to use. For instance, suppose one wishes to use, on the average, 30% solids and 70% liquids. Then the aggregate capacity of the bins and tanks should be as close as possible to 30 and 70% of the total load, respectively. Furthermore, the ratio of tank sizes, on the one hand, and bin sizes, on the other, should be determined by the relative proportions of each component to be used. Because some soluble fuel may be added to the oxidizer liquid and some soluble oxidizer may be added to the fuel liquid (as long as neither liquid is rendered explosive thereby within the above definition of explosive liquids), it is a relatively easy matter to adapt a slurry of the type described below to the pump truck. A typical pump truck had an oxidizer liquid capcity of about 15,000 pounds, a fuel liquid capacity of about 5000 pounds, a solid oxidizer bin capacity of about 7500 pounds, and a solid fuel bin capacity of about 2000 pounds. The fuel bin on this pump truck was designed primarily to handle free-flowing aluminum to be used only when one wishes to obtain a sharply increased bulk strength, e.g., at the bottom of the borehole. With these selections of relative sizes and the flexibility made possible by the use of some oxidizer in the fuel liquid and some fuel in the oxidizer liquid, one may generally utilize this pump truck to within about 90 percent of ideal capacity while still maintaining considerable flexibility as to the desired slurry compositions which may be mixed and loaded on-site through this unit.

"Redox" chemistry (the chemistry of oxidation-reduction mixtures) has long formed the basis of the commercial explosives. This is true of slurry explosives as well. Thus redox chemistry is firmly established in commercial explosives technology and will no doubt remain so because herein lies the greatest conceivable economy. Moreover, there are literally hundreds of combinations of redox mixtures upon which one may base commercial explosives, slurry or nonslurry. Well recognized also is the fact that relative intimacy of mixing of the oxidizer with the fuel is a major, if not a determining, factor in controlling the sensitivity and the performance of any particular redox mixture as an explosive. One should realize, in fact, that once intimacy of mixing of fuel with oxidizer is achieved, almost any reasonably good fuel will sensitize ammonium nitrate to the proper level for commercial explosives uses. Unfortunately, such intimacy of mixing is often very difficult to achieve because commercial oxidizers are generally polar substances, whereas the best, most energetic and economical fuels are generally nonpolar substances and do not readily mix with polar substances, especially when liquid and solution technologies are involved. For this reason the fuel sensitizers for slurry blasting agents have generally either been simply mechanically mixed with the oxidizer as solids or else are soluble in the aqueous oxidizer solution. This limitation has thus restricted prior-art slurry technology largely to solid fuel premixes fed by means of augers or else to soluble fuels. A few systems have, however, employed emulsion technology to achieve a degree of intimacy of mixing but with limited success leaving many of the best fuels (from the viewpoints of both fuel value and economy) inapplicable in slurry technology in the prior-art methods of formulating slurries. The prior art has included several schemes to overcome the antimixing tendency of polar with nonpolar liquids and solution in slurries. For example, oil-in-water and water-in-oil (or more properly oil-in-aqueous solution-in-oil) emulsions have been and indeed are today being extensively used to formulate (as intimately as such technology will permit) commercial redox slurries to make use in some cases of liquid explosives and related liquids, but mostly fuel oil, an excellent fuel of high fuel value and economy but a poor slurry sensitizer "(cf. U.S. Pat. Nos. 3,147,163; 3,242,019; 3,356,547; 3,367,445; 3,419,444; 3,617,406; 3,637,445; 3,674,578; 3,715,247, and 3,919,016.)" The main reason for the poor sensitizing quality of fuel oil is simply that these emulsions, being both thermodynamically and mechanically unstable, tend to permit segregation of the oil so that, as time goes on, they may even become too insensitive to detonate. In the meantime, they deteriorate as to performance. While slurry explosives based on fuel oil emulsions are still among the most economical and popular slurry blasting agents in today's commercial industry, they are thus not without serious limitation. For example, an emulsified, fuel-oil-sensitized slurry often has to be detonated within a few hours of the time it is formulated; otherwise it will tend to separate and become too insensitive to perform efficiently, if at all. In the miner's vernacular, slurries of this type generally "will not sleep," meaning that they cannot be permitted to remain long in the borehole before being detonated or they may not even detonate. While many open-pit mines operate on a load-and-shoot schedule and thus tolerate the poor "sleeping" quality of fuel-oil-sensitized slurries even though reduced efficiency begins immediately, in general large operations cannot tolerate a poor "sleeping" quality in a slurry explosive because the mines usually cannot be operated efficiently by daily firing of shots. For instance, while they may load slurry daily, many of the large taconite operations on the Mesabi Iron Ranges of Minnesota and Michigan fire their blasts only about once a week. The prior art emulsion-type slurries cannot therefore be used in such operations.

Another serious limitation of the redox slurries of prior art, and particularly the oil emulsion-type slurries, is that they cannot be detonated at their natural densities, that is, at the densities obtained without artifically limiting their densities by special aeration techniques ("gassing") or by incorporating in the slurry a low-density porous solid. For instance, without such density control a fuel-oil-sensitized slurry will have a density around 1.35 g/cc when the oxidizer liquid is simply an aqueous AN solution of fudge point around 50° C. But this density is much too high for this slurry to be detonable. By artificially lowering the density to around 1.0 g/cc, however (i.e., by gassing the slurry or by incorporating say porous glass beads), it is capable of excellent performance. This same situation is true of nearly all redox slurries or slurry blasting agents, but one measure of their intrinsic sensitiveness is how high a density may be employed without rendering the slurry nondetonable. This density is known as the critical density. However, critical density is not a fixed quantity for any particular slurry but depends on the diameter of the slurry charge and the temperature, both of which must always be specified wherever critical density is referred to. For instance, critical density increases sometimes rather sharply with increases in temperature in a given charge diameter, or at constant temperature the critical density increases, also sometimes fairly sharply, with charge diameter. Thus critical density is a very important factor in slurry technology. Moreover, density must be carefully regulated without destroying the continuity-in-fluid-phase which characterizes slurry explosives and gives them their intrinsic water resistance. These factors are all well recognized by those familiar in the art of slurry explosives.

The principal object of the present invention is a new and improved blasting slurry system.

Another object is a method of manufacturing such a system.

A further object is a blasting slurry of improved stability.

Another object is a blasting slurry system composed entirely of ingredients which are nonexplosive per se.

Another object is a blasting slurry system composed of ingredients which can be mixed without augers.

A further object is a blasting slurry composed of ingredients adapted to be mixed by gravity flow.

Another object is a blasting slurry system so characterized as to make possible the use of fuels not previously adaptable to use in any blasting slurry.

An additional object is a blasting slurry system in which the critical density is higher at a given charge diameter and temperature than in comparable slurries of the prior art.

Other objects will be appreciated from the following description of the invention.

The present invention relates to newer, safer, and more stable blasting slurry systems and their manufacture. The invention comprises forming new nonpolar fuel liquids for mixing with polar oxidizer liquids to form stable and safe blasting slurries. In most embodiments, solid oxidizers and solid fuels are also included.

The new fuel liquids are formed by special handling of the various fuel sensitizers. The fuel sensitizer is incorporated in a fuel liquid by one of the following means: (1) the fuel sensitizer is suspended in a nonpolar liquid or solution; (2) the fuel sensitizer is used as a nonpolar liquid emulsified in a polar liquid or solution; or (3) the fuel sensitizer is a nonpolar liquid containing a dissolved dispersing agent. In (2) and (3) the requirement of the fuel (in order to overcome in simple fashion the nonsleeping qualities of the insoluble liquid fuel slurries) is that it is in liquid form or else suspended in a liquid in the holding tank but in solid form at the temperature of the borehole and preferably at that temperature that results when hot oxidizer liquid and hot fuel liquid are mixed together in the slurry mixing funnel with cold oxidizer solid, the main purposes of which are to provide rapid cooling during the mixing and loading cycle and minimize the water requirement. Thus, it is desirable, but not absolutely essential, that as the fuel liquid mixes with the oxidizer liquid and solid oxidizer and, if desired, also solid fuel, the sensitizing liquid fuel is suddenly dispersed as fine solid in the aqueous slurry system under the influence of dispersing agents. Once the proper intimacy is established with the finely divided fuels, there is no tendency for segregation of fuels simply because the fuels are then in solid form. Crystal growth of the solid oxidizer precipitated from the saturated solution as it cools, another factor contributing to slurry deterioration not always properly recognized and coped with may be prevented or controlled in the present invention, if desired, by the agents used to disperse the oxidizer and fuel solutions, and sometimes also by proper combinations of eutectic mixtures such as the use in the solution(s) of a nearly 3/1 ammonium nitrate/sodium nitrate ratio, a nearly 1/1 ammonium nitrate-calcium nitrate ratio, or a nearly 1/1.1 ammonium nitrate/urea ratio.

Fuel sensitizers which may be used in the present invention include, but are not limited to, dinitrotoluene, solutions of tall oil, refined or crude naphthalene, crude or refined paraffin wax in dinitrotoluene or nitrobenzene, crude (pitch) tall oil, etc., all of which have melting points at least 10° C above borehole temperature and which may be emulsified in oxidizer liquids either by themselves or with the help of dispersing agents, preferred examples of which are glacial acetic acid and hydroxyalkyl guar gum dissolved in either the oxidizer liquid, the fuel liquid, or both. Insoluble finely divided solid fuels may also be used in the present invention by introducing them as suspensions in the fuel liquid. Gilsonite is an example. When such low freezing fuels as nitrobenzene and tall oil of high oleic acid content are introduced as emulsions in the oxidizer liquid, it is desirable to use them as solvents for (or dissolved in) higher melting fuel liquids on a side of and a long way from the eutectic composition such as to raise the melting point at least 10° C above the borehole temperature in order to give the slurry a satisfactory sleeping quality.

Any oxidizer solution with a fudge point of 40° C or higher (normally 50° to 55° C) may be used for the purposes of the invention, including but not limited to ammonium nitrate/water, ammonium nitrate/sodium nitrate/water, ammonium nitrate/calcium nitrate/water, ammonium nitrate/urea/water, and AN/calcium nitrate/sodium nitrate/water, each of which may or may not be partially thickened by incorporation of a suitable thickening agent such as guar gum. However, some of these oxidizer liquids such as ammonium nitrate/water are calcium nitrate preferred by reason or their suspending and/or emulsifying properties for the preferred fuel liquids of this invention.

The above principles of slurry formulation with immiscible liquids may best be illustrated by means of the following specific examples bringing out excellent dispersing agents and/or fuel-dispersing methods of practical (economic) value.

DINITROTOLUENE (DNT)

Dinitrotoluene is an excellent, relatively low-cost and energetic sensitizer for high percentage ammonium nitrate explosives being used extensively for this purpose in the dry blasting agent "Nitramon" marketed for many years by DuPont. However, because of its physical characteristics with minor exceptions (U.S. Pat. No. 3,328,217) it has not found use in blasting slurries of prior art. Some surprising discoveries have, however, made dinitrotoluene a preferred sensitizer in the redox slurries of this invention. In the liquid state (melting point 52° to 56° C in the case of the dinitrotoluene products used in the studies leading to this invention) dinitrotoluene readily dissolves glacial acetic acid (HAc) which, when present in dinitrotoluene to the extent of from about 0.5 to 10 percent, acts as a dispersing agent for emulsifying dinitrotoluene in oxidizer liquid. Thus when the fuel liquid is a solution of 99.5/0.5 to 90/10 dinitrotoluene/acetic acid, excellent intimately mixed dinitrotoluene-sensitized redox slurries are readily formulated by flowing the various prethickened oxidizer liquids at about 65° C and dinitrotoluene fuel liquid at the same temperature into the mixing funnel of a pump truck along with up to 30% solid (prilled) ammonium nitrate or mixtures of free-flowing aluminum and prilled ammonium nitrate and suitable cross-linking and density-control agents.

A still more surprising discovery of the present invention is the fact that dinitrotoluene/acetic acid fuel liquid readily forms a stable emulsion in oxidizer liquid thickened with a hydroxyalkyl guar gum of Stein-Hall, Inc., sold under the trade name "Jaguar HP-8" or "HP-8" so that a practical fuel liquid that may be carried in one or even both tanks of the pump truck described above without serious segregation is emulsion rich in DNT in an oxidizer liquid thus rendering it a fuel liquid. For instance, a preferred stable emulsion of the present invention comprises 20% of a 98/2 dinitrotoluene/acetic acid solution is 66.6 to 69.6/15/15 to 18/0.2 to 0.4 ammonium nitrate/NHCN (Norsk Hydro calcium nitrate)/water/HP-8. Such emulsions were found to be sufficiently stable that they did not segregate noticeably when held at 65° C for several hours and did not propagate a detonation wave at this temperature in 5 inch cardboard tubes using the 2 × 2 inchpentolite booster.

Another important discovery was the fact that DNT-sensitized slurries made either with dinitrotoluene/acetic acid or dinitrotoluene/acetic acid/oxidizer liquid as the fuel liquid had remarkably high sensitiveness as evidenced by critical densities as high as 1.4 g/cc, much higher than the slurry blasting agents of prior art.

EXAMPLE I

A 6145-gram slurry charge was made by emulsifying 905 grams of molten dinitrotoluene (melting point 52° C) in an aqueous solution of 3330 grams ammonium nitrate (AN), 800 grams "Norsk-Hydro" calcium nitrate (abbreviated "NHCN" and composition ca. 77.5% $Ca(NO_3)_2$, 7.5% $NH_4NO_3$, and 15% water), 550 grams water, and 25 grams HP-8 gum at 65° C. To this emulsion was added 500 grams prilled ammonium nitrate, a trace of "DyChem" foamer and 1 gram "DU-6" cross-linker also from Stein-Hall, Inc., conveyed to the solution in 10 grams glacial acetic acid. The final mixture was rapidly stirred vigorously for a few seconds (to simulate "pump truck" mixing) and then poured into a 4 inch (3.87 inch inside diameter × 24 1 inch long) cardboard tube giving a final charge 21 inches in length. Three days later this charge was shot with a 2 × 2 inch pentolite booster with the slurry at a density of 1.38 g/cc and at about 20° C. It detonated completely and powerfully in a charge length of 5.4 charge diameters (21 inches). An essentially equivalent charge of 6005 grams made exactly the same way but without the "DyChem" foamer had a density of 1.46 g/cc but at about 20° C propagated only 2.9 charge diameters in a charge of total length (L) 5 charge diameters (20¼ inches) using the same size 2 × 2 inch pentolite booster. This example indicated therefore that the critical density of this slurry at 20° C and in 4 inch cardboard tubes was about 1.4 g/cc.

GILSONITE

Gilsonite is an excellent high fuel value, very fine-grained solid hydrocarbon of potentially appreciable sensitizing quality, especially by virtue of its hydrophobic surface characteristics with the propensity of occluding tiny air bubbles. However, in the prior art it has been possible to use it only as an auxiliary, nonsensitizing fuel in a "premix" with other sensitizing solid fuels-aluminum and sulfur (cf. U.S. Pat. Nos. Re25,695; 3,249,477; 3,714,914) which is augered into the slurry mixing funnel (cf. U.S. Pat. Nos. 3,303,738, 3,380,333). Unfortunately the premixing of gilsonite with sulfur and fine-grained aluminum is dangerous having incurred some accidents and requiring stringent mixing procedures and regulations. These disadvantages of gilsonite are overcome by using it as a suspension in a fuel liquid either using the principle of gravity stabilization or in conjunction with the dinitrotoluene-emulsion of Example I. For example, gilsonite may be used as a fuel sensitizer by introducing it in a gravity-stabilized solution of dinitrotoluene and pitch tall oil in a high melting wax-nitrobenzene solution in which the suspending medium has a density between 1.04 and 1.1 (depending on the specific gravity of the particular gilsonite used) and a melting point at least 10° C above the temperature of the environment in which it is used (the borehole).

On the other hand, one should avoid the use of gilsonite in hot oxidizer liquids in amounts in excess of about 3 to 4 percent (depending on the oxidizer liquid) because such suspensions when hot (temperature above 50° C) may be high explosives per se. For example, a suspension of 8% gilsonite in an oxidizer liquid containing 69.7% ammonium nitrate, 12% $Ca(NO_3)_2$, 18% water, and 0.3% hydroxypropyl guar gum detonated completely at 60°-65° C in long 3 inch diameter (2⅞ inch inside diameter) cardboard tubes when initiated with 2 × 2 inch pentolite. Thus hot oxidizer or fuel liquid suspensions of gilsonite, with the gilsonite being present in excess of about 3 to 4 percent, are not within the definitions of "fuel liquid" and "oxidizer liquid" employed here because such suspensions may be explosive per se.

Examples II and III illustrate the combination dinitrotoluene (liquid fuel) gilsonite (in oxidizer liquid) sensitization of slurries by the methods of this invention.

EXAMPLE II

Two approximately 10 kg. "slurry" batches were prepared by first formulating at 65° C a fuel liquid of 98/2 dinitrotoluene/glacial acetic acid and an oxidizer liquid at 65° C comprising a suspension of 3.6% gilsonite in 96.4% of an oxidizer liquid comprising 70.3/12/17/0.3 ammonium nitrate/$Ca(NO_3)_2$/water/-hydroxypropyl guar gum.

The slurry was then formulated by rapidly mixing 13.3% of the fuel liquid, 66.5% of the oxidizer liquid, 20% prilled AN, and 0.2% of a 16.5% suspension of the cross-linker "DU-6" of Stein-Hall in a 2/1 solution of $NaNO_2$ in water.

After a brief, vigorous stirring to simulate pump truck mixing, the slurry was poured into 3 inch and 4 inch diameter cardboard tubes (of 2⅞ inch and 3⅞ inch inside diameter, respectively). The densities (at 20° C) of the two 3 inch charges were 1.07 and 1.15 g/cc, while those of the 4 inch charges were 1.19 and 1.22 g/cc. The charge lengths were 22 inches, 25 inches, 29¼ inches, and 30¾ inches, respectively. All charges detonated completely (and powerfully) at about 20° C with 2 × 2 inch pentolite boosters showing that the critical densities in about 3 and 4 inch diameter charges at about 20° C were in excess of 1.15 g/cc and 1.22 g/cc, respectively.

EXAMPLE III

Two approximately 10 kg. batches of slurry were prepared and poured into 4 inch cardboard tubes in the same manner as in Examples I and II with the final slurries both containing 4.8% DNT and 4.24% gilsonite. In this case 0.25% hydroxypropyl guar gum and 0.25% acetic acid were used for thickening, emulsifying, and suspending the dinitrotoluene, gilsonite, and about 0.05% sodium nitrate (the decomposition of which was also promoted by the glacial acetic acid) was used to control density. Day-old charges of 4 inches (d) × 20 inches (L), 5 inches (d) × 28¾ inches (L), and 4 inches (d) × 34¼ inches (L), were detonated with 2 × 2 inch pentolite boosters. The first and third charges detonated at 20° C and densities of 1.15 and 1.17 g/cc, but the second charge, also at about 20° C, failed after propagating about 3.8 charge diameters at a density of 1.2 g/cc. This example showed that the critical density of the 4.8% DNT, 4.24% gilsonite slurry in about 4 inch diameter charges at about 20° C is about 1.17 g/cc, while in 3 inch diameter charges it is about 1.15 g/cc.

DENSITY SCANNING

Two series of density-scanning tests were conducted to determine critical diameter, one with combinations of dinitrotoluene and gilsonite and the other with combinations of dinitrotoluene and pitch tall oil. This amounted simply to determining the maximum density for complete propagation of the slurry in a given charge size and at a given temperature (in these cases 4 inches (d) and 20° C) by firing charges over a range of densities. The results of these tests — conducted all with the same oxidizer liquid as in Example II, all using 0.3 ± 0.1 percent acetic acid, and all with a final composition at about zero OB — showed that all-gilsonite and all-pitch tall oil-sensitized slurry blasting agents had a critical density of about 1.1 g/cc, an all-dinitrotoluene-sensitized slurry had a critical density of about 1.4 g/cc, and mixed (suspension-emulsion) gilsonite-DNT or emulsion pitch tall oil-dinitrotoluene slurries had critical densities increasing approximately linearly with dinitrotoluene content from roughly 1.1 g/cc at zero dinitrotoluene to 1.4 at 15% dinitrotoluene.

NAPHTHALENE AS A FUEL IN SLURRY BLASTING AGENTS

Naphthalene is theoretically an attractive fuel for slurry blasting agents by virtue of its relatively low cost (at least of crude naphthalene) and high fuel value. However, like dinitrotoluene, gilsonite, pitch tall oil, and high-melting paraffin waxes, its physical properties have hindered its application in slurries of prior art. Yet it has some interesting physical properties which make it a particularly useful fuel when applied in the method of the present invention. For example, it is soluble at elevated temperatures in both liquid dinitrotoluene and nitrobenzene, both solutions of which may be readily dispersed in oxidizer liquid by means of small percentages of glacial acetic acid and hydroxyalkyl gum in solution in either the fuel liquid, the oxidizer liquid, or both. Example IV illustrates a fuel liquid comprising a solution of naphthalene in dinitrotoluene.

EXAMPLE IV

A fuel solution comprising 44/54/2 dinitrotoluene/naphthalene (melting point of $C_{10}H_8$ ca. 79° C)/acetic acid in the amount of 8.1 parts was rapidly emulsified at 65° C with 71.6 parts of a hot oxidizer liquid of composition 69.4/15/15/0.4 ammonium nitrate/Norsk-Hydro calcium nitrate/$H_2O$/HP-8 guar gum simultaneously cooled with 20 parts solid (prilled) ammonium nitrate, and cross-linked and gassed with 0.05 parts Stein-Hall "DU-6" cross-linker suspended in 0.05 parts $NaNO_2$ dissolved in 0.1 parts water. The slurry was then poured into a 4 inch (d) cardboard tube and found to have a density of 1.11 g/cc when it was detonated the following day with a booster comprising a (leftover) hot, 4 inch (d) × 15 inch (L) gilsonite-sensitized slurry initiated at 20° C with 2 × 2 inch pentolite. It propagated completely the entire length (15.5 inches) with the charge standing upright producing a crater about 1½ feet in diameter and 1½ feet deep.

PETROLEUM WAXES

Petroleum waxes of melting point appreciably above borehole temperatures are potentially economically attractive fuels for redox slurries which also have not found application in slurry blasting agents of prior art because of their troublesome physical properties with respect to formulating intimately mixed slurries with them. However, the present invention offers an attractive means of utilizing such potentially attractive fuels.

Various waxes of melting point ranging from 25° to 56° C were studied. Refined paraffin was found useful by dissolving it in a grade of tall oil which was liquid at ambient temperature (i.e., of high oleic acid content) or by incorporating it either as a suspension in an oxidizer liquid having a fudge point below 56° C or as an emulsion incorporated as a liquid fuel solution above 56° C. In use in a liquid fuel suspension, the wax was first dissolved in hot tall oil and then precipitated in the form of ultra-fine particles by rapid cooling and stirring (more accurately "creaming"). Alternately, lower melting crude wax was used as an emulsion either alone, together with a dispersing agent, or solution with a more easily emulsified fuel liquid such as nitrobenzene. For example, a crude petroleum wax having a broad melting point in the range between 25° C and 35° C and a density of 0.82 g/cc was found soluble in large proportions in nitrobenzene and in solutions of nitrobenzene, DNT, and tall oil. These solutions also dissolved glacial acetic acid, thus rendering them more readily dispersable as emulsions in oxidizer liquids (particularly the preferred oxidizer liquid used in most of the examples of this invention) as illustrated by Example V.

EXAMPLE V

A fuel liquid comprising 44/54/2 nitrobenzene/petroleum wax (melting point 25°–35° C)/acetic acid was emulsified at 65° C with 7.3 parts by weight in 72.7 parts of the oxidizer liquid of Example II also at 65° C and cooled, cross-linked, and gassed with 20 parts prilled ammonium nitrate, 0.05 parts "DU-6" cross-linker, and 0.05 parts $NaNO_2$ in 0.1 parts water, respectively. The slurry was then poured into a 5 inch (d) cardboard tube to give a slurry charge of length (after cooling to ambient temperature) 27¾ inches at a (2-day, cold) density of 1.10 g/cc. This slurry at about 20° C was detonated with a cast 2 × 2 inch pentolite booster in an upright position on the ground. It detonated completely producing a crater roughly 2 feet in diameter and 2 feet deep.

One may often obtain definitive information in exploratory studies by firing charges somewhat (but not far) above the critical density and measuring the distance of propagation of the fading detonation. Thus with a single shot (in lieu of density scanning as exemplified above in the case of dinitrotoluene and either pitch tall oil or gilsonite) one may estimate the critical density within relatively close limits. This is illustrated by five examples of crude wax in different fuel liquids in Table I from which it was estimated that wax/tall oil, wax/nitrobenzene/naphthalene, and wax/oleic acid-rich tall oil redox slurries formulated by the emulsion technique described in this invention have critical densities comparable to or slightly above that of the pitch tall oil and gilsonite-sensitized slurries described above, i.e., they have critical densities around 1.1 g/cc in 4 inch diameter cardboard tubes at 20° C. A wax/dinitrotoluene/naphthalene/acetic acid of high acetic acid content detonated at the density at which it had been expected to exhibit fading by reason of a high acetic acid content, hence was not useful in estimating the critical density.

PITCH TALL OIL

Tall oil is available in various grades, most of which (those rich in oleic acid) are liquid at ambient temperatures and thus generally not "sleepable" slurry sensitizers. Yet oleic acid-rich tall oil, being surface active, appears less prone to leak out of redox slurries than fuel oil, even though its melting point is low. On the other hand, the "pitch" grade tall oil (lean in oleic acid and rich in acid resins) has a melting point at least 10° C above most borehole temperatures in accord with the limitation herein specified for a proper sleepable slurry and thus particularly attractive as a slurry sensitizer or as a component of other fuel liquids since it is soluble in (or a solvent for) petroleum waxes, liquid dinitrotoluene, and nitrobenzene. It also dissolves acetic acid which aids in its dispersion as an emulsion in oxidizer liquid, in cross-linking, and in promoting gassing with $NaNO_2$. To study its own sensitizing quality, a number of tall-oil-sensitized slurries were prepared and tested with results showing in general that tall-oil-sensitized redox slurries are comparable in sensitiveness at a given temperature and charge diameter with gilsonite-sensitized slurries independent of the melting point and composition of the tall oil. To assure good sleeping quality, however, the high-melting "pitch"-grade tall oil is needed. Example VI is typical of a tall-oil-sensitized slurry using in this case the low-melting tall oil.

TABLE I

| Fuel Liquid* | Fuel Liquid Percentage | Charge Sizes≠ | Density (g/cc) | Length of Fading Detonation | Estimated Critical Density (g/cc) |
|---|---|---|---|---|---|
| Wax/tall oil/acetic acid 49/49/2 | 6.2 | 5" (d) × 23¾" (L) | 1.28 | 16¾" | 1.15 |
| Wax/oleic acid/acetic acid 48/48/4 | 6.0 | 5" (d) × 25" (L) | 1.23 | 19" | 1.15 |
| Wax/ dinitrotoluene/HAc 49/49/2 | 8.5 | 5" (d) × 32" (L) | 1.27 | 12" | 1.1 |
| Wax/nitrobenzene/naphthalene/HAc | 7.2 | 5" (d) × 28¼" (L) | 1.14 | 22½" | 1.05 |
| Wax/dinitrotoluene 25.9/25.3/28.3/20.5 | 8.4 | 4" (d) × 26" (L) | 1.1 | complete detonation | >1.1 |

*The wax was in every case a crude petroleum wax of melting point from 25 to 35° C, and the oxidizer liquid was 66.6 to 67.8% ammonium nitrate, 15% norsk-hydro calcium nitrate, 15 to 18% water, 0.2 to 0.4% HP-8.
≠The inside diameters were in all cases ⅛" less than the designated diameter.

EXAMPLE VI

A 7000-gram charge of a tall-oil-sensitized slurry was formulated in the manner described heretofore by emulsifying six parts tall oil to which had been added 0.4 parts HAc with 73.6 parts of the preferred hot (65° C) oxidizer liquid given in a footnote of Table I. To this was added 20 parts solid (prilled) ammonium nitrate, 4 grams of the Stein-Hall "DW-3" cross-linker, and 4 grams of $NaNO_2$ dissolved in 8 grams of water. The slurry was then poured into a 4 inch (d) long cardboard tube. The final (cold) charge, as measured 2 days later, had a density of 1.06 g/cc and a length of 33½ inches. (Even though the low-melting tall oil was used in this example, this 2-day old slurry showed no indication of leaking tall oil, as is often observed with fuel oil slurries of this age indicating a better sleeping quality than in fuel-oil-sensitized redox slurries.) It was then detonated at about 20° C upright on the ground with a 2 × 2 inch pentolite booster producing a crater about 1½ feet in diameter and 1 foot deep.

Solutions of pitch tall oil and DNT provide an attractive means of varying the critical density, sensitiveness, and quality (or cost) of slurry blasting agents of the present invention because these two fuels are soluble at high temperatures in all proportions. One may also vary the strength in this series of slurries by adding various percentages of free-flowing, (weakly sensitizing or non-sensitizing) aluminum (e.g., Alcoa 1622). From density-scanning tests it was learned that an all-pitch-tall-oil-sensitized slurry has a critical density of about 1.1 g/cc in 4 inch diameter unconfined (or cardboard-tube-confined) charges at 20° C. The critical density at 20° C may be raised to about 1.2 g/cc by using up to 10% free-flowing aluminum with all-tall-oil sensitization. The critical density at the opposite end of the series (all-dinitrotoluene sensitization) is about 1.4 g/cc which may be raised to about 1.5 g/cc by the use of up to 10% free-flowing aluminum. Examples VII, VIII, and IX illustrate the excellent sensitiveness of the pitch-tall-oil-sensitized and mixed dinitrotoluene-pitch-tall-oil-type fuel liquid-sensitization of slurry blasting agents.

EXAMPLE VII

A fuel liquid comprising 96/4 pitch tall oil/HAc in the amount of 6.5% was rapidly mixed with 73.3% oxidizer liquid (see Table 1) both at 65° C, 20% prilled ammonium nitrate, 0.05% "DW-3" cross-linker, and 0.16% (1/2) $NaNO_2$/water. While the resulting slurry was cross-linking and gassing, it was poured into a 5 inch (d) cardboard tube to give a charge when 5 days old having a density of 1.07 g/cc and a length of 29.5 inches. This charge detonated completely with a 2 × 2 inch pentolite booster at about 20° C. A 10 kg charge of the same composition made in the same way and also poured into a 5 inch (d) cardboard tube had a density of 1.15 g/cc and detonated completely at about 20° C in a charge of 29 inches in length with the 2 × 2 inch pentolite booster.

EXAMPLE VIII

Ten percent of a fuel liquid comprising 48/48/4 dinitrotoluene/pitch tall oil/HAc at 65° C was rapidly and vigorously mixed in a same manner intended to simulate pump truck mixing with 69.8% of the hot oxidizer liquid as of Table I at 65° C, 20% prilled ammonium nitrate, 0.05% "DW-3" cross-linker, and 0.14% gasser (1/2 $NaNO_2$/water). While cross-linking and gassing, the slurry was poured into 3 inch (d) and 4 inch (d) cardboard tubes to give 5-day-old charges (at about 20° C) having densities of 1.12 and 1.13, and lengths of 19.5 inches and 9.3 inches, respectively. Both charges detonated completely producing surprisingly large craters, again using 2 × 2 inch pentolite as the booster. In addition, two (2-day-old) 4 inch (d) × 22⅜inch (L) charges of the same composition made in the same way also detonated completely at about 20° C with 2 × 2 inch pentolite boosters. In another test with this same composition to which had been added 3% free-flowing aluminum, a charge of 4 inches (d) × 20 inches (L) at a density of 1.24 detonated completely using the 2 × 2 inch pentolite booster.

EXAMPLE IX

Using 11.6% of a 76/22/2 dinitrotoluene/pitch tall oil/HAc fuel liquid at 65° C, the oxidizer liquid shown in Table I at 65° C, 20% prilled ammonium nitrate, 0.05% "DW-3" cross-linker, and 0.12% of the 1/2 $NaNO_2$/water gassing solution, two charges, both of 4 inches (d) × 22⅜inches (L), detonated completely at densities of 1.23 and 1.24 g/cc and at about 20° C, again using 2 × 2 inch pentolite boosters.

The above descriptions exemplify preferred fuel solutions of the present invention in all three of the following categories (also mentioned above):

1. Suspensions of solid fuels in polar or nonpolar liquids or solutions.

2. Emulsions of liquid fuels (soldifying upon cooling by mixing with cold solids) at a temperature considerably above the borehole temperature where the slurry is to be used.

3. Nonpolar fuel liquids with dissolved dispersing agents for rapid and uniform dispersion in thickened (or to be thickened and cross-linked) oxidizer liquid.

I intend to be limited only by the following patent claims:

1. A stable blasting slurry having prolonged stability resulting from the process comprising mixing followed by rapid cooling of a hot (40° to 70° C), guar-gum thickened (by up to 0.5% guar gum) oxidizer liquid with a hot (also 40° to 70° C) fuel liquid fortified with up to 10% dispersing or emulsifying agent and said fuel liquid being either a fuel sensitizer in itself or containing a dissolved or suspended fuel sensitizer dispersed in a liquid carrier, or both, the resulting mixture being gelled by means of a cross-linking agent for guar gum in an amount up to 20% of guar gum thickener content, the stable blasting slurry being density controlled by means of pre-determined quantity of foaming or gassing agent or a low-density porous solid, with the proviso that the aforesaid fuel liquids are limited to those having melting points at least 10° C higher than ambient temperatures.

2. The stabile blasting slurry resulting from mixing an oxidizer liquid with a fuel liquid wherein said fuel liquid comprises a fuel sensitizer dispersed in a liquid carrier, with the proviso that the aforesaid fuel liquids are limited to those having melting points at least 10° C higher than ambient temperatures.

3. The stabile blasting slurry of claim 2 wherein said fuel liquid comprises a solid fuel sensitizer suspended in a polar liquid.

4. The stabile blasting slurry of claim 2 wherein said fuel liquid comprises a solid fuel sensitizer suspended in a nonpolar liquid.

5. The stabile blasting slurry of claim 2 wherein said fuel liquid comprises gilsonite suspended in a density-matched 43/55/2 solution of pitch-grade tall oil, nitrobenzene, and glacial acetic acid.

6. The stabile blasting slurry of claim 2 wherein said fuel liquid comprises a nonpolar liquid emulsified in a liquid carrier.

7. The stabile blasting slurry of claim 2 wherein said fuel liquid comprises liquid dinitrotoluene containing 0.5 to 10 percent glacial acetic acid in an oxidizer liquid thickened with guar gum.

8. The stabile blasting slurry of claim 2 wherein said fuel liquid comprises a nonpolar liquid emulsified in a liquid carrier, and mixed with an oxidizer liquid and a solid oxidizer as a coolant.

9. The stabile blasting slurry of claim 2 wherein said fuel liquid comprises liquid dinitrotoluene containing 0.5 to 10 percent acetic acid emulsified in an oxidizer liquid thickened with up to 0.5% hydroxyalkyl guar gum in such proportions that the resulting emulsion becomes the fuel liquid with the dinitrotoluene being the fuel sensitizer mixed with an oxidizer liquid and cooled with solid prilled ammonium nitrate.

10. The stabile blasting slurry of claim 2 wherein said fuel liquid comprises a nonpolar liquid emulsified in a polar liquid.

11. The stabile blasting slurry of claim 2 wherein said fuel liquid comprises tall oil dissolved in liquid dinitrotoluene containing 0.5 to 10 percent glacial acetic acid in an oxidizer liquid thickened with guar gum.

12. The stabile blasting slurry of claim 2 wherein said fuel liquid comprises dinitrotoluene at 65° C as the nonpolar liquid.

13. The stabile blasting slurry of claim 2 wherein said fuel liquid comprises petroleum wax of melting point above 25° C dissolved in tall oil.

14. The stabile blasting slurry of claim 2 wherein said fuel liquid comprises petroleum wax of melting point above 25° C containing dissolved nitrobenzene.

15. The stabile blasting slurry of claim 2 wherein said fuel liquid comprises a nonpolar liquid containing a dissolved dispersing agent.

16. The stabile blasting slurry of claim 2 wherein said fuel liquid comprises dinitrotoluene, emulsified in a thickened oxidizer liquid.

17. The stabile blasting slurry of claim 2 wherein said fuel liquid comprises dinitrotoluene containing 0.5 to 10% acetic acid, emulsified in a thickened oxidizer liquid.

18. The stabile blasting slurry of claim 2 wherein said fuel liquid comprises naphthalene dissolved in dinitrotoluene and 0.5 to 10 percent glacial acetic acid.

19. A method of preparing a stabile blasting slurry which comprises forming a fuel liquid by dispersing a fuel sensitizer in a liquid carrier and mixing said fuel liquid with an oxidizer liquid.

20. The method of claim 19 wherein the fuel liquid is formed by suspending a solid fuel in a nonpolar liquid.

21. The method of claim 19 wherein the fuel liquid is formed by emulsifying a nonpolar liquid in a liquid carrier.

22. The method of claim 19 wherein the fuel liquid is formed by emulsifying a nonpolar liquid in a liquid carrier, and mixing said fuel liquid with an oxidizer liquid and a cool solid oxidizer.

23. The method of claim 19 wherein the fuel liquid is formed by emulsifying a nonpolar liquid in a polar solution.

24. The method of claim 19 wherein the fuel liquid is formed by dissolving a nonpolar substance in a nonpolar liquid.

25. The method of claim 19 wherein the fuel liquid is formed by dissolving a nonpolar liquid in a nonpolar liiquid and mixing said fuel liquid with a thickened oxidizer liquid.

26. A stabile blasting slurry resulting from mixing dinitrotoluene containing dissolved acetic acid with a thickened oxidizer liquid.

27. A stabile blasting slurry resulting from forming an emulsion by mixing dinitrotoluene containing dissolved acetic acid with ammonium nitrate, calcium nitrate, water and gum.

28. A stabile blasting slurry resulting from emulsifying molten dinitrotoluene in an aqueous solution of ammonium nitrate, calcium nitrate and gum, and mixing with an oxidizer liquid.

29. A stabile blasting slurry resulting from emulsifying molten dinitrotoluene in an aqueous solution of ammonium nitrate, calcium nitrate, and gum, and mixing with said emulsion, solid ammonium nitrate and a cross-linker in glacial acetic acid.

30. A stabile blasting slurry resulting from mixing gilsonite suspended in a fuel liquid and an oxidizer liquid.

31. A stabile blasting slurry resulting from mixing gilsonite suspended in a fuel liquid and a thickened oxidizer liquid.

32. A stabile blasting slurry resulting from mixing a gilsonite-dinitrotoluene fuel liquid suspension and an oxidizer liquid.

33. A stabile blasting slurry resulting from mixing a gilsonite-dinitrotoluene fuel liquid suspension and a thickened oxidizer liquid.

34. A stabile blasting slurry resulting from mixing a hot oxidizer liquid, hot gilsonite-fuel liquid suspension and prilled ammonium nitrate while adding a cross-linker and a density control agent.

35. A stabile blasting slurry resulting from dissolving naphthalene in a fuel liquid and dispersing in a thickened oxidizer liquid.

36. The slurry of claim 35 wherein the fuel liquid is dinitrotoluene.

37. The slurry of claim 35 wherein the fuel liquid is nitrobenzene.

38. A stabile blasting slurry resulting from dissolving naphthalene in a fuel liquid and dispersing in an oxidizer liquid comprising an aqueous solution of ammonium nitrate, calcium nitrate, and gum, with the addition of solid ammonium nitrate, cross-linker, sodium nitrate and water.

39. A stable blasting slurry resulting from a fuel liquid comprising a suspension of 'creamed' wax in a nonpolar liquid of melting point above 30° C.

40. The blasting slurry of claim 39 wherein the carrier liquid is pitch tall oil.

41. The blasting slurry of claim 39 wherein the carrier liquid is dinitrotoluene.

42. The blasting slurry of claim 39 wherein the carrier liquid is nitrobenzene.

43. A blasting slurry resulting from a pitch tall oil sensitized slurry mixed with solid ammonium nitrate, cross-linker, density control agent and water.

44. The stable blasting slurry, resulting from mixing oxidizer liquid with a fuel liquid wherein said fuel liquid comprises a fuel sensitizer dispersed in liquid carrier, with the proviso that the aforesaid fuel liquids are limited to those having melting points at least 10° C higher than ambient temperatures, wherein the oxidizer liquid has a fudge point above 40° C and wherein the fuel liquid comprises a member of the group consisting of naphthalene, pitch tall oil and high melting waxes, dissolved in a nitrated aromatic hydrocarbon of melting point above 30° C, said fuel liquid being dispersed in said oxidizer liquid as an emulsion at 60° to 65° C by dissolved glacial acetic acid and a hydroxy alkyl gum, said fuel and oxygen liquid dispersion being thickly solidified by the addition of a cold free running solid.

* * * * *